US006563483B1

(12) United States Patent
Sakumoto

(10) Patent No.: US 6,563,483 B1
(45) Date of Patent: May 13, 2003

(54) LIQUID CRYSTAL DISPLAY APPARATUS AND METHOD FOR DRIVING THE SAME

(75) Inventor: Aiichiro Sakumoto, Chigasaki (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/523,180

(22) Filed: Mar. 10, 2000

(30) Foreign Application Priority Data

Mar. 11, 1999 (JP) ..... 11-065472

(51) Int. Cl.[7] ..... G09G 3/36
(52) U.S. Cl. ..... 345/98; 345/100
(58) Field of Search ..... 345/87, 89, 98, 345/99, 100, 96, 94, 204, 208, 209

(56) References Cited

U.S. PATENT DOCUMENTS

| | | | | |
|---|---|---|---|---|
| 4,465,999 A | * | 8/1984 | Tsuzuki | 345/98 |
| 4,926,168 A | | 5/1990 | Yamamoto et al. | |
| 5,642,129 A | | 6/1997 | Zavracky et al. | |
| 5,751,261 A | | 5/1998 | Zavracky et al. | |
| 5,754,157 A | | 5/1998 | Kuwata et al. | |
| 6,380,919 B1 | * | 4/2002 | Koyama et al. | |
| 6,407,727 B1 | * | 6/2002 | Plangger | |

FOREIGN PATENT DOCUMENTS

| | | |
|---|---|---|
| EP | 0 837 445 | 4/1998 |
| JP | 8-286644 | 11/1996 |
| WO | WO 95/20210 | 7/1995 |
| WO | WO 96/16393 | 5/1996 |

* cited by examiner

*Primary Examiner*—Regina Liang
(74) *Attorney, Agent, or Firm*—Oblon, Spivak, McClelland, Maier & Neustadt, P.C.

(57) ABSTRACT

The present invention provides a liquid crystal display apparatus capable of reducing waving and shadowing. The driving circuit portion in the liquid crystal display apparatus according to the present invention has a random number generating circuit 2, a display data RAM 3, a display data RAM address decoder 7, and a row driver 8. The random number generating circuit 2 generates random numbers for setting the scanning order of the row electrodes. The row address decoder 7 sets the scanning order on the row electrodes. The column driver 6 supplies the video data of all the column electrodes corresponding to the scanning row electrode. The scanning order of the scanning lines is set by the random numbers generated by the random number generating circuit 2. Because of this, the scanning order becomes random at each frame, and the shadowing depending to the video data is reduced. Furthermore, because the adjacent scanning lines are not continuously scanned, the waving does not arise.

16 Claims, 5 Drawing Sheets

| |
|---|
| 25, 192, 64, 121, 3, 54, 68, 19, ··· |
| 181, 63, 72, 38, 145, 139, 6, 95, ··· |
| 89, 17, 48, 27, 156, 174, 24, 112, ··· |
| ⋮ |

FIG. 3

| | |
|---|---|
| 94 | |
| 173 | |
| 6 | |
| 25 | |
| 132 | |
| 68 | |
| | ⋮ |

FIG. 4A

| | |
|---|---|
| 21 | |
| 3 | |
| 127 | |
| 185 | |
| 16 | |
| 54 | |
| | ⋮ |

FIG. 4B

| ADDRESS DATA FROM ADDRESS COUNTER | DATA STORED IN ROM |
|---|---|
| 00h | E7h |
| 01h | 60h |
| 03h | A3h |
| 04h | 54h |
| 05h | 9Fh |
| 06h | 55h |
| 07h | CEh |
| ⋮ | ⋮ |
| EDh | 96h |
| EEh | 1Dh |
| EFh | 03h |
| F0h | 5Ah |

FIG. 6

LIQUID CRYSTAL DISPLAY APPARATUS AND METHOD FOR DRIVING THE SAME

BACKGROUND OF THE INVENTION

1. Field of the Invention

The present invention relates to a liquid crystal display apparatus of a simple matrix driving type, which has a plurality of row electrodes (scanning lines) and column electrodes (signal lines) arranged in matrix form, and drives all of column electrodes during driving one row electrode.

2. Related Background Art

In the liquid crystal display (LCD) apparatus of the simple matrix driving type, there is a system scanning the row electrodes arranged to a horizontal direction of a display screen line by line. On the LCD screen, only one line is lighten in a moment. However, because lightening is repeatedly carried out, an eye of human is perceived so that all the screen is lightening.

On the other hand, when the LCD screen becomes large and the number of the scanning lines increases, if each row electrode is not scanned at high speed, a flicker is likely visible. In order to reduce the flicker, it is necessary to set the number of scanning frame to more than 25 times per one minute. One frame time, that is, a lightening time for one line is set by the number of scanning frames per one minute. The more the number of the scanning lines is, the shorter the lightening time is. The shorter the lightening time for one line is, the lower the ratio of ON/OFF of the liquid crystal, that is, a contrast ratio becomes; as a result, the more the screen image is blurred.

By improvement of the liquid crystal material, it is possible to compensate deterioration of the contrast. However, undesirable problems such as shadowing and waving occurs, thereby deteriorating display quality. The shadowing designates a phenomenon that shadow emerges at non-lightening points, as shown in FIG. 1. In order to reduce the shadowing, it is general to detect turning point of the ON/OFF of the liquid crystal and to apply a supplement voltage at the points. However, because a circuit for detecting the turning points of the ON/OFF and a circuit for applying the supplement voltage has to be added, the cost is up and mounting area becomes necessary too much.

Next, the waving will be explained. The liquid crystal has a characteristic that its properties deteriorate when the voltage is applied only to one direction. Therefore, ordinarily, the polarity of the voltage applied to the liquid crystal is periodically switched, and the voltage applied to the liquid crystal is controlled so as to become plus minus zero. As a specific method of the polarity inversion, there are a frame inversion that the polarity inverts at each frame (each screen), and a dot inversion that the polarity inverts at each dot.

For example, in the case of the line inversion, if the polarity inversion is carried out at every submultiple pieces of all the horizontal lines, the polarity is inverted by the same line at each frame. As a result, the line showing change-over of the polarity is perceived.

On the other hand, in the case of the frame inversion, as a property of CMOS transistor constituting the driving circuit, penetrating current flows. Therefore, the driving voltage goes down and the contrast changes undesirably.

Because of this, in the liquid crystal display apparatus of simple matrix driving type, the polarity is switched at every prime factor pieces of lines, for example, 13 or 17 pieces.

When the polarity is switched at every the prime factor pieces of lines, a least common for the number of all lines becomes large, and the location that the polarity of the driving voltage switches changes at each frame. As a result, the line showing change-over of the polarity is not perceived.

However, even if inverting the polarity at every prime factor pieces of lines, there is a case that the line to switch the polarity inversion is perceived so that the wave flows. In order to reduce such a waving, it is necessary to provide the horizontal lines more than the number of the horizontal lines in the display area and to prevent the occurrence of the wave by controlling a surplus divided by a prime factor. Because of this, the scanning control is complicated and a new circuit becomes necessary.

SUMMARY OF THE INVENTION

The present invention has been developed in consideration of the above-described respects, and a object of the present invention is to provide a liquid crystal display apparatus capable of reducing the shadowing and the waving.

To attain the above-described object, according to the present invention, there is provided a liquid crystal display apparatus comprising:

a plurality of row electrodes and column electrodes arranged in matrix form;

a row electrode driving circuit for driving each of said row electrodes in random order; and a column electrode driving circuit for driving each of said column electrodes.

According to the present invention, because each of the row electrodes is driven in random, it is possible to reduce the shadowing depending to the video data. Furthermore, because the adjacent row electrodes are not continuously scanned, the waving does not occur and the display quality is improved.

In the present invention, if pattern strings showing the scanning order of the row electrodes is stored in the storing apparatus in advance, it is possible to quickly decide the scanning order of the row electrodes and to surely drive each of the row electrodes within a prescribed time, even if there are a lot of the row electrodes.

BRIEF DESCRIPTION OF THE DRAWINGS

FIG. 3 is scanning order patterns stored in the nonvolatile memory.

FIGS. 4A–4B is a diagram showing scanning order.

FIG. 6 is a diagram showing a relationship between the output of the address counter and the corresponding data read out from the row electrodes.

DESCRIPTION OF THE PREFERRED EMBODIMENTS

Preferred embodiments of the present invention will be described below with reference to the drawings.

(First Embodiment)

Figure 2:
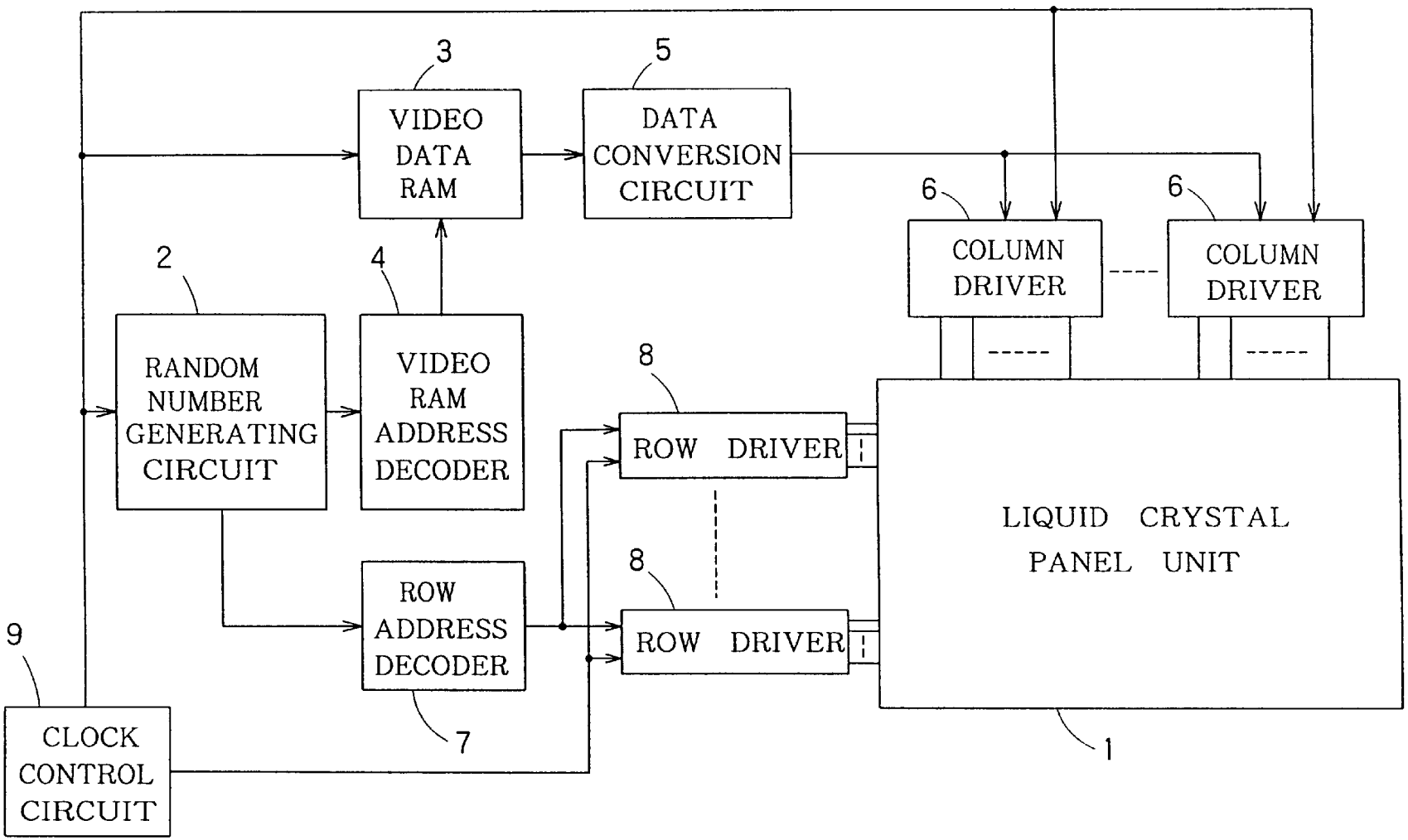
FIG. 2 is a block diagram showing a first embodiment of a liquid crystal display apparatus.

FIG. 2 is a block diagram showing a first embodiment of a liquid crystal display apparatus according to the present invention. The liquid crystal display apparatus of FIG. 2 has a module on which a liquid crystal panel unit 1 and a portion of a driving circuit are formed.

The driving circuit of the liquid crystal display apparatus according to the present invention, as shown in FIG. 2, has a random number generating circuit 2, a video data RAM 3, a video RAM address decoder 4, a data conversion circuit 5, a column driver 6, a row address decoder 7, and a row driver 8.

The random number generating circuit 2 generates random numbers which is used to set scanning order of the row electrodes L1–Ln. The random number generated by the random number generating circuit 2 does not need to be a complete random number. the random number may be pseudo random numbers constituted of pattern string with long period. For example, the random number generating circuit 2 may be provided with a ROM for storing a plurality of patterns showing the scanning order of the row electrodes L1–Ln, and the scanning order may be set by reading out the patterns showing the scanning order in the ROM.

The video data RAM 3 is a RAM for storing the video data. Because the scanning order changes randomly, a frame buffer capable of storing the video data for one screen is used.

The video RAM address decoder 4 is a decoder for selecting data stored in the video data RAM 3, and decodes addresses of the video data RAM 3 corresponding to the random number outputted from the random number generating circuit 2.

The data conversion circuit 5 is constituted in the same way as the conventional circuit, and carries out a parallel/serial conversion of the video data in accordance with the number of the input data bits of the column driver 6.

The column driver 6 is constituted in the same way as the conventional one, and supplies the video data supplied from the data conversion circuit 5 to each column line at a time.

The row address decoder 7 sets the scanning order based on the random number outputted from the random number generating circuit 2. Specifically, the row address decoder 7 supplies to the row driver 8 a chip select signal of the row driver 8 constituted of a plurality of chips and a signal showing the display output order.

The row address decoder 8 becomes an enable status by the chip select signal from the row address decoder 7. The row driver 8 selects its output terminal by a decoder in the row driver 8, based on a signal showing the display output order from the row address decoder 7, and then scans each of the row lines L1–Ln based on the selected result.

Next, the operation of the liquid crystal display apparatus showing in FIG. 2 will be explained. The following is an example of having a nonvolatile memory such as ROM or RAM for storing a plurality of types of the scanning order patterns. The scanning order patterns stored in the nonvolatile memory, for example, as shown in FIG. 3, are constituted of pattern strings with the same number as that of the row electrodes L1–Ln. The numeral of FIG. 3 shows the numeral of the row electrodes. In the nonvolatile memory, a lot of patterns as shown in FIG. 3 is stored. These patterns are constituted of numeral strings close to the random number so that the scanning order of the row electrodes L1–Ln does not coincide at each frame.

The random number generating circuit 2 repeatedly reads out the patterns showing the scanning order stored in the nonvolatile memory. When the patterns are repeatedly read out, the random number generating circuit 2 outputs the same pattern at every prescribed period. When many patterns are stored in the nonvolatile memory, there is few frequency to read out the same pattern. As a result, the same advantageous effect as that by outputting the random number is obtained.

The patterns showing the scanning order outputted from the random number generating circuit 2 is inputted to the video data RAM address decoder 4 and the row address decoder 7. The video data RAM address decoder 4 selects addresses of the video data corresponding to the scanning row electrodes based on the pattern showing the scanning order, and supplies the selected address to the video data RAM 3. The video data RAM 3 outputs the video data in accordance with the scanning row electrodes. The video data read out from the video data RAM 3 is converted from parallel data to serial data, and then supplied to the column driver 6. The column driver 6 supplies these video data to each of the column electrodes C1–Cm at the same timing.

On the other hand, the row address decoder 7 sets the scanning order of the row electrodes L1–Ln, based on the patters showing the scanning order outputted from the random number generating circuit 2. The row driver 8 drives each of the row electrodes L1–Ln in accordance with the order the row address decoder 7 sets.

Accordingly, in a certain frame, for example, the scan is carried out in an order showing in FIG. 4A, and in the next frame, so that the scanning order is different from the previous frame, the scan is carried out in an order showing in FIG. 4B. The numerals of FIGS. 4A and 4B expresses the scanning order.

Thus, the first embodiment sets the scanning order of the scanning lines in accordance with the random numbers generated by the random number generating circuit 2. Because of this, the scanning order becomes random at every frame, and the shadowing depending to the video data is reduced. That is, even when displaying the image that the shadowing is subject to happen, the occurrence of the shadowing is prevented.

Furthermore, because the adjacent scanning lines are scanned continuously, the waving does not happen and the display quality is improved.

Because the patterns showing the scanning order are stored in advance in the random number generating circuit 2, it is possible to quickly decide the scanning order. Accordingly, even when there are many row electrodes, it is possible to drive all the row electrodes within a prescribed time. Furthermore, it is possible to use the conventional data conversion circuit 5 and column driver 6 as it is, thereby cutting cost for design change.

(Second Embodiment)

A second embodiment has a feature that a ROM is used as the random number generating circuit.

Figure 1:
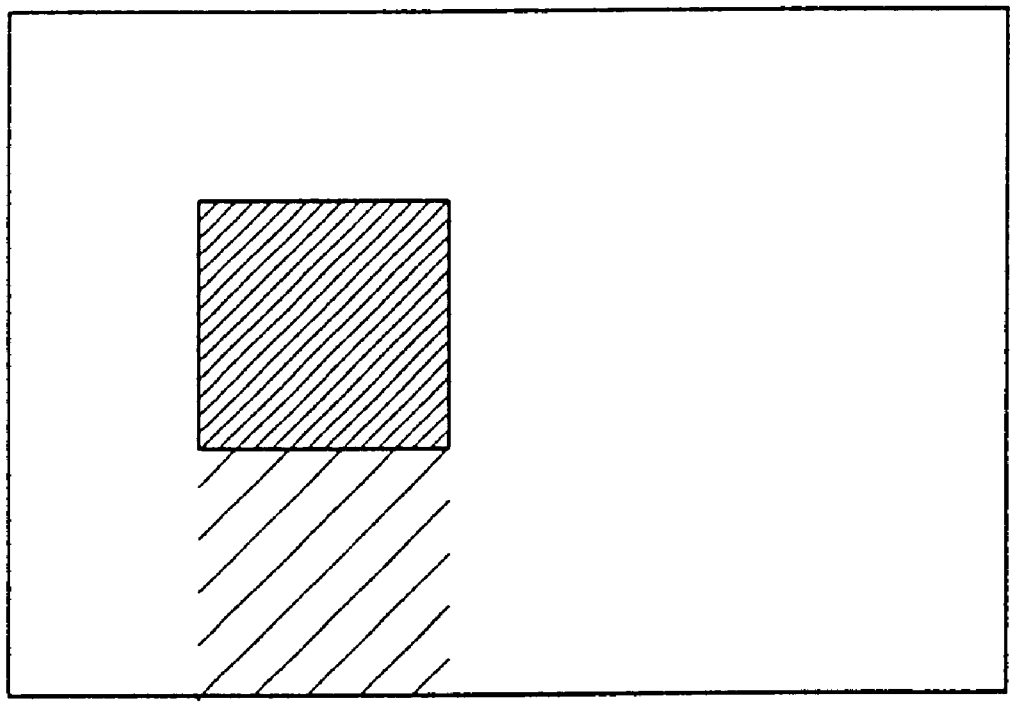
FIG. 1 is a diagram explaining the shadowing.
Figure 5:
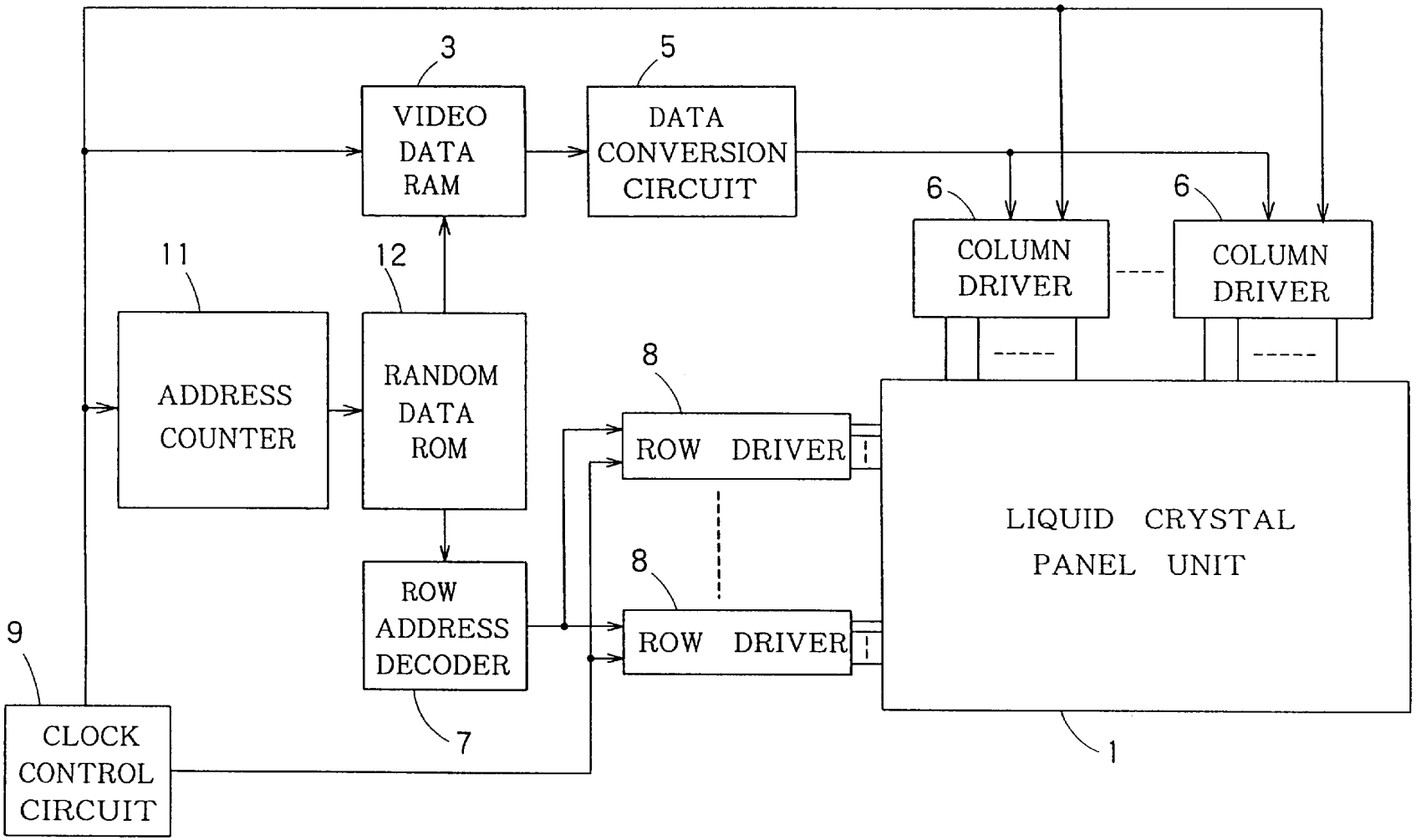
FIG. 5 is a block diagram showing the second embodiment of a liquid crystal display apparatus.

FIG. 5 is a block diagram showing the second embodiment of a liquid crystal display apparatus according to the present invention. In FIG. 5, the constituents common to those of FIG. 1 are denoted with the same reference numerals, and mainly the different respects will be described hereinafter.

The liquid crystal display apparatus of FIG. 5 has an address counter 11 and the random data ROM 12, instead of the display data RAM address decoder.

The address counter 11 outputs read-out addresses of the random data ROM 12. Specifically, the address incremented one by one is outputted.

In the inside of the random data ROM 12, the random data showing the order scanning the row electrodes is stored.

FIG. 6 is a diagram showing a relationship between the output of the address counter 11 and the corresponding data read out from the row electrodes, and shows an example having 240 pieces of the row electrodes. As shown in FIG. 6, when the address increments one by one, the random data is outputted from the random data ROM 12.

Data read out from the random data ROM 12 is transferred to the row address decoder 7 and the video data RAM 3. The row address decoder 7 decides the scanning order of the row electrodes based on data read out from the random data ROM 12. The video data RAM 3 decides the order to read out the video data.

The column driver 6 drives all the column electrodes at the same timing, based on the video data read out from the video data RAM 3.

Furthermore, the random data ROM 12 of FIG. 5 is applicable to any nonvolatile memory such as mask ROM, EPROM, EEPROM, and FRAM.

In the above-mentioned second embodiment, examples providing the ROM for storing the patterns showing the scanning order in the random number generating circuit 2 have been explained. The patterns showing the scanning order may be stored in the RAM, and the patterns showing the scanning order may be programmably changed.

Otherwise, instead of storing the patterns showing the scanning order in advance, the random numbers may be calculated and the scanning order may be set at each scanning of the scanning lines.

What is claimed is:

1. A liquid crystal display apparatus comprising:

a plurality of row electrodes and column electrodes arranged in matrix form;

a row electrode driving circuit for driving each of said row electrodes in random order;

a column electrode driving circuit for driving each of said column electrodes;

a random data output circuit for outputting random data;

a video memory for storing video data; and a video address decoder for deciding order to read out said video memory based on said random data, wherein said column electrode driving circuit drives all of said column electrodes at the same timing, based on the video data read out from said video memory in accordance with the decided read-out order, and said row electrode driving circuit decides driving order of said row electrodes based on said random data.

2. A liquid crystal display apparatus according to claim 1, said column electrode driving circuit drives all of the column electrodes while said row electrode driving circuit drives one row electrode.

3. A liquid crystal display apparatus, comprising, a plurality of row electrodes and column electrodes arranged in matrix form;

a row electrode driving circuit for driving each of said row electrodes in random order;

a column electrode driving circuit for driving each of said column electrodes; and a random data output circuit for outputting random data, wherein said row electrode driving circuit decides driving order of said row electrodes based on said random data, and said random data output circuit has a storing apparatus for storing a plurality of pattern strings showing the order for driving said row electrodes, and an address generating apparatus for outputting addresses to read out the pattern strings stored in said storing apparatus.

4. A liquid crystal display apparatus according to claim 3, wherein said row electrode driving circuit reads out the pattern strings stored in said storing apparatus, and decides the order for driving said row electrodes, based on each of the read-out pattern strings.

5. A liquid crystal display apparatus according to claim 4, wherein said row electrode driving circuit and said column electrode driving circuit allow the polarity of voltage applied to bdth of said row electrodes and said column electrodes at every multiple row electrodes to invert, and said random data output circuit sets a type of said pattern strings for storing in said storing apparatus.

6. A liquid crystal display apparatus according to claim 3, wherein said storing apparatus is a read-only memory.

7. A liquid crystal display apparatus according to claim 6, wherein said storing apparatus is any among mask ROM, EPROM, EEPROM and FRAM.

8. A liquid crystal display apparatus according to claim 3, wherein said storing apparatus is a readable and writable memory.

9. A method for driving a liquid crystal display apparatus, including a plurality of row electrodes and column electrodes arranged in matrix form, a row electrode driving circuit for driving each of said row electrodes, a column electrode driving circuit for driving each of said column electrodes, a random data output circuit for outputting random data, and a video memory for storing video data, said row electrodes being driven in random order based on said random data, respectively, comprising:

deciding read-out order of the video memory for storing video data based on said random data, wherein said column electrode driving circuit drives all of said column electrodes at the same timing, based on the video data read out from said video memory in accordance with the decided read-out order.

10. A method for driving a liquid crystal display apparatus according to claim 9, wherein said column electrode driving circuit drives all the column electrodes while said row electrode driving circuit drives one row electrode.

11. A method for driving a liquid crystal display apparatus according to claim 9, wherein said row electrode driving circuit decides the order for driving said row electrodes, based on random data outputted from a random data output circuit.

12. A method for driving a liquid crystal display apparatus according to claim 11, wherein said random data is any among random numbers, pseudo random numbers, and data for long period.

13. A liquid crystal display according to claim 1, wherein said random data is any among random numbers, pseudo random numbers, and data with a long period.

14. A method for driving a liquid crystal display apparatus, including a plurality of row electrodes and column electrodes arranged in matrix form, a row electrode driving circuit for driving each of said row electrodes and a column electrode driving circuit for driving each of said column electrodes, said row electrodes being driven in random order, respectively, comprising:

outputting random data, deciding read-out order of a video memory for storing video data based on the random data, wherein said column electrode driving circuit drives all of said column electrodes at the same timing, based on the video data read out from said video memory in accordance with the decided read-out order, and said step of deciding read-out order of the video memory has further the steps of:

storing a plurality of random pattern strings showing the order for driving said row electrodes; and outputting addresses to the deciding read-out order of the video memory for reading out the pattern strings stored in said random pattern string storage.

15. A method for driving a liquid crystal display apparatus according to claim 14, said row electrode driving circuit repeatedly reads out the pattern strings stored in said storing apparatus in order, and decides the order for driving said row electrodes based on each of the read-out pattern strings.

16. A method for driving a liquid crystal display apparatus according to claim 14, wherein said row electrode driving circuit and said column electrode driving circuit allow polarity of voltage applying to said row electrodes and said column electrodes to invert at every multiple row electrodes, and said step of deciding read-out order of the video memory sets a type of said pattern strings for storing in said storing apparatus, so that line showing polarity inversion is not perceived.

* * * * *